United States Patent [19]

MacFee

[11] Patent Number: 4,691,370

[45] Date of Patent: Sep. 1, 1987

[54] RECLOSABLE BULK MATERIAL BAG WITH SLIDE FASTENER

[75] Inventor: Norman W. MacFee, Stanley, N.C.

[73] Assignee: Talon, Inc., Meadville, Pa.

[21] Appl. No.: 848,227

[22] Filed: Apr. 4, 1986

[51] Int. Cl.[4] ..... B65D 33/26

[52] U.S. Cl. ..... 383/61; 383/79; 383/84; 383/97; 190/903

[58] Field of Search ..... 383/61, 78, 79, 84, 383/97, 109, 114; 190/903

[56] References Cited

U.S. PATENT DOCUMENTS

| | | | |
|---|---|---|---|
| 2,436,369 | 2/1948 | Allen | 190/903 |
| 2,563,933 | 8/1951 | Hipps et al. | 190/903 |
| 2,934,255 | 4/1960 | McDuffie | 383/79 |
| 2,975,955 | 3/1961 | McCurry | 383/109 |
| 3,755,993 | 9/1973 | Cote | 383/97 |
| 4,241,865 | 12/1980 | Ferrell | 383/61 |
| 4,335,817 | 6/1982 | Bahr | 383/66 |
| 4,337,889 | 7/1982 | Moertel | 383/61 |
| 4,620,320 | 10/1986 | Sullivan | 383/61 |

FOREIGN PATENT DOCUMENTS

| | | | |
|---|---|---|---|
| 677403 | 3/1930 | France | 383/97 |
| 2313276 | 12/1976 | France | 383/97 |

*Primary Examiner*—Stephen P. Garbe

[57] ABSTRACT

A bulk material bag includes an inner bag united with a cover bag. One tape of a closed slide fastener overlaps the interior of an inner bag rear top extension and is secured thereto. The top extension, together with the attached closed slide fastener and a rear top cover bag flap is folded over the front face of the cover bag and the second tape of the slide fastener is secured to the front face of the cover bag and the flap is secured to the front face of the cover bag and covers and protects the slide fastener until the initial opening of the bulk material bag.

10 Claims, 7 Drawing Figures

RECLOSABLE BULK MATERIAL BAG WITH SLIDE FASTENER

BACKGROUND OF THE INVENTION

1. Technical Field:

The present invention relates to reclosable bags for bulk solids, and more particularly relates to an improved slide fastener closure for such bags.

2. Description of the Prior Art:

Slide fastener equipped reclosable bags for bulk material are disclosed in U.S. Pat. Nos. 4,335,817 and 4,337,889. In the latter patent, closure tapes for the mouths of bulk material bags are disclosed in several different configurations. In each case, the closure tape spans the mouth of the bag and is secured to the bag side walls near the mouth by adhesive or by stitching or a combination of both means. In several configurations, a slide fastener is installed in the closure tape at one side of the bag mouth. The slide fastener in each case is exposed and unprotected. In other configurations disclosed in the patent, a slide fastener is installed between the side walls of the bag inwardly of the bag mouth and the closure tape extending across the mouth. These configurations, in essence, define two completely separate bag closures, namely, a first or outer closure and a second or inner closure. The arrangement is somewhat complex and costly. Still other configurations in the patent show slide fasteners placed within the bag mouth and across the opening of the mouth, with a separate tape closure provided over and across the bag mouth and the slide fastener thereon. Again, essentially two separate bag closure structures are involved.

SUMMARY OF THE INVENTION

The invention is summarized in a reclosable bag for bulk materials including an inner bag having a mouth, a rear top extension projecting somewhat above the mouth, a cover or outer bag containing and united with the inner bag and having a rear top closure flap extending well beyond the inner bag rear top extension, and a closed slide fastener having one tape thereof secured to the interior of the inner bag rear top extension.

The arrangement is such that the rear top extension of the inner bag along with the attached slide fastener and cover bag closure flap can be folded over the exterior of the bag front wall and the second tape of the slide fastener secured to the exterior of the bag front wall, said closure flap being also secured to the bag front wall somewhat below the second tape of the slide fastener. The slide fastener is completely enclosed and protected prior to the initial opening of the bag, and then allows the bag to be opened and reclosed as many times as necessary during the dispensing of its contents.

An object of the invention is to provide an improved slide fastener closure for a reclosable bulk material bag which will reduce spillage of the bag contents, and form an effective vermin barrier.

Another object of the invention is to provide a slide fastener closure for bulk material bags which is more convenient, more secure and less complicated than prior art closures, and accordingly less expensive to manufacture.

Still another object of the invention is to provide a slide fastener closure for a bulk material bag in which the slide fastener is located near the mouth of the bag, on one side of the mouth, and beneath a protective flap which extends across the bag mouth and has an end portion releasably attached to the same side of the bag which carries the slide fastener.

Other objects and advantages of the invention will be apparent from the following description of the preferred embodiment taken in conjunction with the accompanying drawings.

DESCRIPTION OF THE PREFERRED EMBODIMENTS

Figure 1:
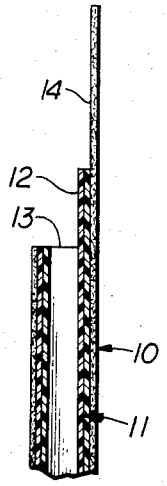
FIG. 1 is a fragmentary vertical cross section taken through the mouth of a bulk material bag of the type employed in the present invention.
Figure 2:
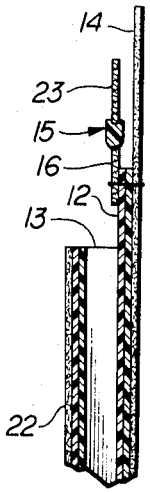
FIG. 2 is a similar section showing a closed slide fastener installed on the bag adjacent to its mouth.
Figure 4:
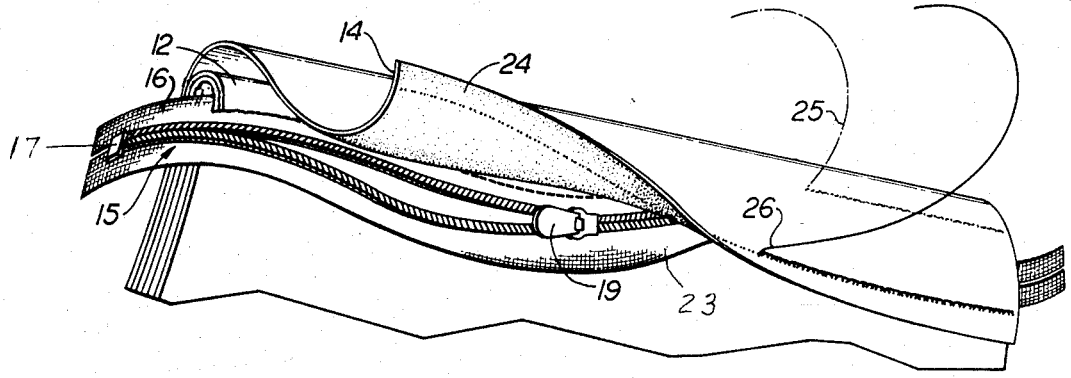
FIG. 4 is a fragmentary perspective view of the bag with the slide fastener and adjacent closure components released.
Figure 5:
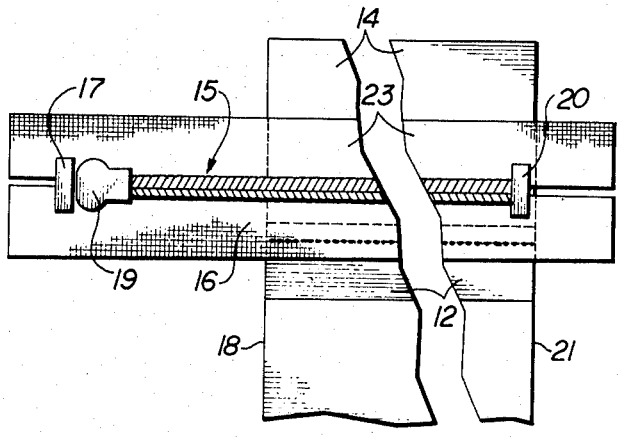
FIG. 5 is a fragmentary side elevation of the bag as depicted in FIG. 2.

As shown in FIG. 1, a bulk material bag formed from paper and/or polymer resin comprises a cover or outer bag 10 suitably united with an inner bag 11. The resulting bag structure may have any suitable number of plies, as shown. A relatively short rear top extension 12 of the inner bag 11 extends above the mouth 13 of the bag, and a considerably longer rear top closure flap 14 of the outer bag 10 extends beyond the inner bag extension 12. As shown in FIGS. 4 and 5, the extension 12 and flap 14 extend across the full width of the bag.

In a first step of making the reclosable bag according to the present invention, a closed slide fastener 15 of any preferred type has one tape 16 thereof placed in overlapping relationship with the front of the extension 12 and secured thereto by adhesive means and/or stitching. Preferably, the tape 16 overlaps about one-half of the front face of the inner bag extension 12.

As viewed in FIG. 5, the closed slide fastener 15 is attached to the extension 12 front face down, and the top of the slide fastener defined by its top stop 17, extends beyond the adjacent edge 18 of the bag for a distance of at least one-half the open thickness of the bag plus approximately $\frac{5}{8}$ inch. This construction reduces strain on the slide fastener while pouring out the contents of the bag. The slide fastener slider 19 is depicted in FIG. 5 along with a bottom stop 20 located adjacent to the other edge 21 of the bag.

Figure 3A:
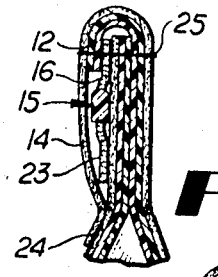
FIG. 3*a* is a fragmentary vertical section taken through the mouth of the bag and adjacent bag closure means with the bag completely closed.
Figure 3B:
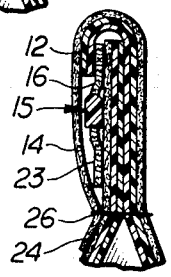
FIG. 3*b* is a view similar to FIG. 3*a* showing a modification of FIG. 3*a*.

Following the installation of the slide fastener 15, as described, the extension 12 along with the attached slide fastener and the closure flap 14 is folded over and across the mouth 13 of the bag and downwardly over the bag front face 22. The previously unattached second tape 23 of the slide fastener 15 is now secured by adhesive to the front face 22 so that the slide fastener, as shown in FIGS. 3*a* and 3*b* lies on the front face of the closed mouth end portion of the bag. Similarly, the previously free end portion of the flap 14 is secured by adhesive 24 to the front face of the bag. The closure flap 14 now completely covers and protects the slide fastener 15 until the bag is initially opened by releasing the closure flap 14. The adhesive attachment 24 for the flap 14 is located below the slide fastener tape 23, FIG. 3.

To complete the security of the bag closure, a line of chain stitching 25 (FIG. 3*a*)can be installed through the folded flap 14, extension 12 and bag walls slightly below the bag mouth. An alternative location for the chain stitching is indicated at 26, FIG. 3*b*, where the line of stitching is through the closure flap 14 and bag walls but not through the slide fastener tape 23. The first-described location for the chain stitching is the preferred location. The chain stitching may be unnecessary in some instances, and therefore may be omitted entirely. Vapor barriers and strengthening strips, not shown, may be used under the chain stitching.

The adhesive used in the installation of the slide fastener 15 may be applied to its tapes prior to attaching or to proper areas of the bag. Alternatively, strip hot melt adhesive may be applied concurrently with application. In some cases, no stitching may prove to be necessary for securing the tape 16 to the extension 12, in which case adhesive alone will be used and the slide fastener installation takes place in only one step.

To open the bag, as depicted in FIG. 4, the outside closure flap 14 is pulled open after first releasing the chain stitching 25 or 26, if such stitching is employed. The slide fastener 15 is now exposed and is opened by the operation of its slider 19. Following this, the flap 14, short extension 12 and the attached slide fastener tape 16 with its coupling elements are swung to the open position relative to the mouth of the bag so that the contents of the bag or any portion thereof may be emptied. The bag is easily reclosed by returning the parts to their relative positions shown in FIGS. 3*a* and 3*b*, followed by closing of the slide fastener 15.

Figure 6:
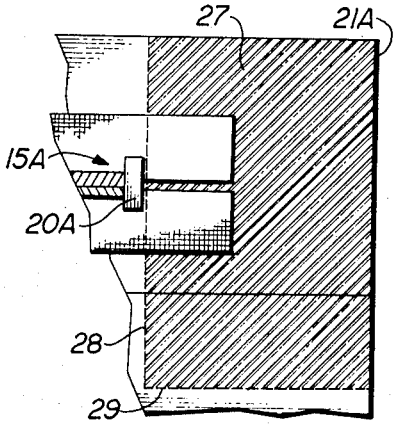
FIG. 6 is a fragmentary view similar to FIG. 5 showing a modification.

FIG. 6 shows a slight modification of the invention in which a somewhat shorter slide fastener 15*a* having a bottom stop 20*a* is employed. The shorter slide fastener terminates short of the edge 21*a* of the bulk material bag. In this situation, the adjacent corner portion 27 of the bag is firmly sealed in the entire rectangular area encompassed by the lines 28 and 29.

Various forms of slide fasteners may be employed for the present invention, and the invention is not restricted to using a slide fastener. Hook and loop fastener means could be employed as could extruded interlocking plastics fasteners and snaps, both metal and plastics.

Since many variations, modifications and changes in detail may be made in the above-described embodiments of the invention, it is intended that all matter in the foregoing description and in the accompanying drawings be interpreted as illustrative and not in a limiting sense.

I claim:

1. A reclosable bag comprising a bag body having first and second opposing wall portions and a mouth, an extension on the first wall portion of the bag body projecting somewhat beyond said mouth, a closure flap on the first wall portion projecting a greater distance beyond said mouth and projecting beyond said extension, a separable fastener having a first part secured to said extension and including a second part, the separable fastener, said extension and closure flap being foldable as a unit across said mouth and into overlapping relationship with the exterior of the second wall portion of the bag body, and means attaching the second part of the separable fastener and said closure flap to the exterior of the second wall of the bag body, whereby said flap entirely covers and protects the separable fastener until the flap is released in the initial opening of the bag.

2. A reclosable bag as claimed in claim 1, and said separable fastener comprising a slide fastener, said first and second parts comprising first and second tapes of the slide fastener, the first tape of the slide fastener being secured to the interior of said extension, and the second tape of the slide fastener being secured to the exterior of the second wall of the bag body after folding the slide fastener, extension and closure flap into overlapping relationship with the exterior of the second wall portion of the bag body.

3. A reclosable bag as claimed in claim 2, and one end portion of said slide fastener extending freely beyond one side of the bag body when the mouth of the bag body is in a substantially closed non-dispensing condition.

4. A reclosable bag as claimed in claim 2, and the first tape of the slide fastener being secured to the interior of said extension by adhesive means, the second tape of the slide fastener and closure flap being secured to the exterior of the second wall portion of the bag body by adhesive means.

5. A reclosable bag as claimed in claim 4, and a line of chain stitching penetrating the first and second wall portions of the bag body near said mouth.

6. A reclosable bag as claimed in claim 1, and the bag body comprising united inner and cover bags, said extension being on a wall portion of the inner bag and said closure flap being on the corresponding wall portion of the cover bag.

7. A reclosable bulk material bag comprising a bag body having first and second opposing wall portions and a mouth, a relatively short extension and a longer closure flap on the first wall portion of the bag body and both being foldable across the mouth of the bag body into overlapping relationship with the exterior of the second wall portion of the bag body, a slide fastener having a first tape secured to the interior of the relatively short extension and having a second tape which is freely disposed and lies opposite the interior of the closure flap before folding with the extension and closure flap into overlapping relationship with the exterior of said second wall portion, and means securing the second tape of the slide fastener and an end portion of the closure flap to the exterior of the second wall portion separately along spaced substantially parallel lines across said exterior of the second wall portion, whereby the closure flap prior to release covers and protects the slide fastener.

8. A reclosable bulk material bag as claimed in claim 7, and the slide fastener being closed when secured to said extension and remaining closed when said second tape is secured to the exterior of said second wall portion.

9. A reclosable bulk material bag as claimed in claim 8, and said second tape and end portion of the closure flap being secured adhesively to the exterior of the second wall portion.

10. A reclosable bulk material bag comprising a bag body having first and second wall portions defining a bag mouth and one wall portion extending somewhat beyond the mouth and the other wall portion, a bag closure flap on said one wall portion of the bag body and being foldable with the extending part of said one wall portion across said mouth and into overlapping relationship with the exterior of the second wall portion, a closed slide fastener having a first tape secured to the interior of the extending part of said one wall portion in overlapping relationship therewith, the closed slide fastener being foldable with said closure flap and extending part into overlapping relationship with the exterior of said other wall portion of the bag body, means securing a second tape of the closed slide fastener to the exterior of the second wall portion after said folding, and means releasably securing said closure flap to the exterior of the second wall portion at a location thereon more distant from the bag mouth than the secured second tape of the closed slide fastener.

* * * * *